United States Patent [19]

Adams et al.

[11] Patent Number: 4,592,603

[45] Date of Patent: Jun. 3, 1986

[54] FURNITURE SERVER/DESK

[75] Inventors: James E. Adams, High Point; Ernest T. Koontz, Jr.; Steven D. Russell, both of Thomasville, all of N.C.

[73] Assignee: Armstrong World Industries, Inc., Lancaster, Pa.

[21] Appl. No.: 541,588

[22] Filed: Oct. 13, 1983

[51] Int. Cl.[4] ..... A40B 85/00

[52] U.S. Cl. ..... 312/241; 312/282

[58] Field of Search ..... 312/241, 324, 281, 282; 108/63

[56] References Cited

U.S. PATENT DOCUMENTS

| | | | |
|---|---|---|---|
| 806,071 | 11/1905 | Dorsey | 312/287 |
| 2,461,684 | 2/1949 | Dierickx | 312/241 X |
| 2,556,153 | 6/1951 | Collins | 312/281 |
| 2,673,776 | 3/1954 | Barnhart | 108/63 |
| 2,852,325 | 9/1958 | Fosnaugh | 108/63 |
| 3,854,590 | 12/1974 | Dolby | 211/74 |
| 4,436,353 | 3/1984 | Tucker | 312/241 |

*Primary Examiner*—William E. Lyddane
*Assistant Examiner*—Joseph Falk

[57] ABSTRACT

The server/desk is a multi-functional piece of furniture that is unique in a number of ways. Probably the most unique feature is that the top separates revealing a cavity in the back of the furniture that will hold an extra leaf for a dining room table. Self storing leaves in furniture, have never been accommodated in any other item than the table itself. The front section of the top folds out onto supports so that the piece of furniture can be converted into a desk. When the folding tops are put back into their original position, the furniture piece has the appearance of a conventional solid top dining room server. The interior drawer and door features accommodate functions that might be expected from both a dining room server and a writing desk.

3 Claims, 1 Drawing Figure

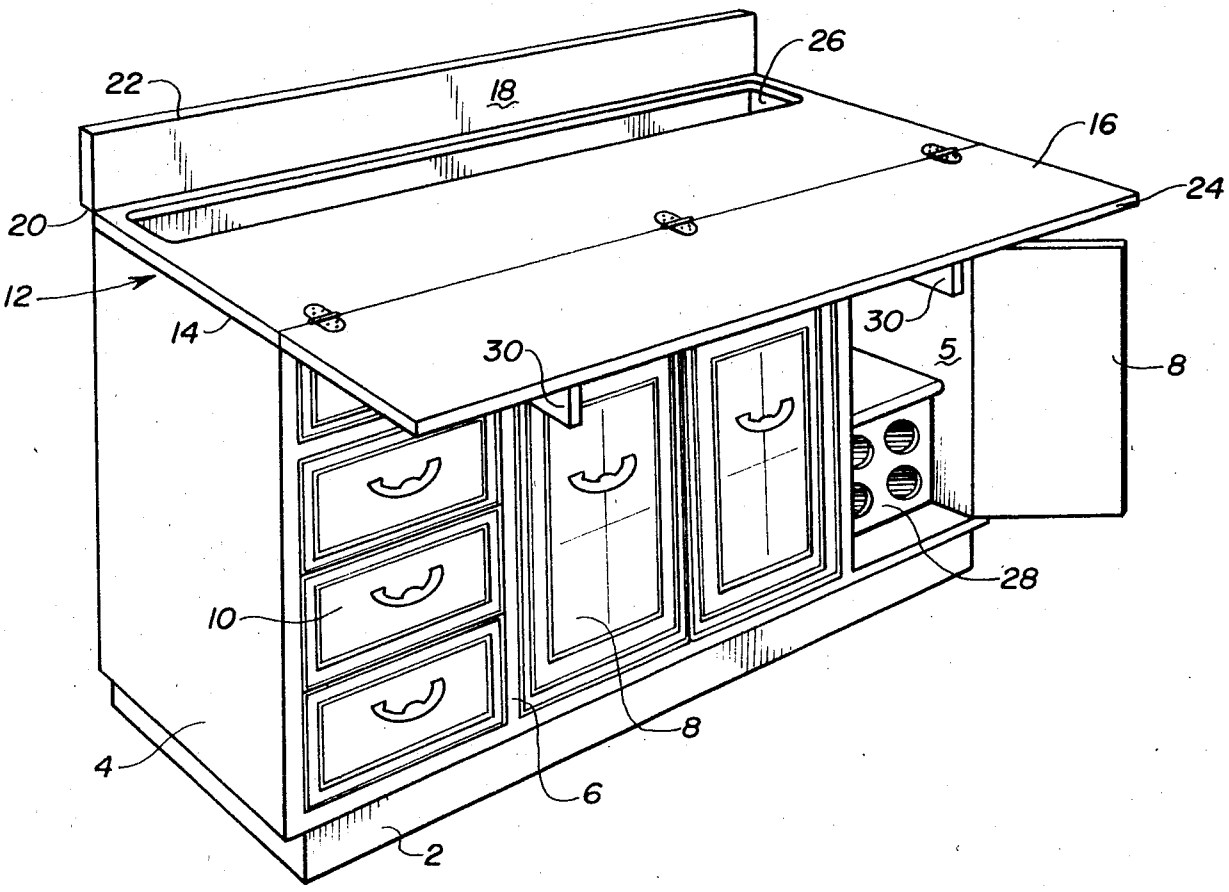
24
16
26
22
20
12
14
18
30
5
8
28
30
8
6
2
10
4

FURNITURE SERVER/DESK

BACKGROUND OF THE INVENTION

1. Field of the Invention

The invention is directed to a furniture piece and, more particularly, to a combination furniture server and desk.

2. Description of the Prior Art

Individually servers and desk have existed in the art and it is conceivable that servers in the past have been used for desks.

The invention herein utilizes a hinged flip top on the top of the server for functioning both as a servicing surface when the piece of furniture functions as a server and as a work surface when the piece of furniture functions as a desk.

A hinged lift top on the back part of the top surface will lift to expose a deep well which is used to accommodate dining table fillers. Self storing leaves in furniture have never been accommodated in any other item than the table itself.

SUMMARY OF THE INVENTION

The invention is directed to a furniture server/desk which has a base with two sidewalls extending upward therefrom. A front panel is provided between the two side walls and it also extends upwardly from the base. The front panel has therein at least one drawer and at least one door. The drawer extends into the area between two side walls and is generally conventional in structure. Normally more than one drawer is utilized, and these drawers could be fitted with a pencil tray or a fitted silver liner, etc.

A door covering a cavity within the two sidewalls could have conventional shelving therein or could have a wine rack, etc. The server/desk has a top section consisting of a first part mounted above the two side walls and the front panel and is actually resting thereon. The first part of the top has a front edge and a back edge and is a continuous structure. Hinged thereto and overlying said first part there are two hinged sections which normally rest upon the first part with one of the hinged sections being attached to the front edge of the first part and the other hinged section being attached to the back edge of the front first part. The two hinged sections together are of the same size as the first part and completely overlie the first part. The back hinged section is approximately one-third to one-fourth the width of the front hinged section. A cavity is positioned below and is covered by the hinged section which is fastened to the back edge of the furniture. The front edge hinge section extends out over the front panel and appropriate supports hold it in position in the same plane as the top section first part, so that it will serve as a desk top.

BRIEF DESCRIPTION OF THE DRAWING

The drawing is a prospective view of the invention herein.

DESCRIPTION OF THE PREFERRED EMBODIMENTS

The furniture server/desk is shown in the drawing. The furniture piece comprises a base 2 which has positioned thereon two side walls 4 and 5. The side walls extend upwardly from either side of the base. A front panel 6 is also provided on the base and it extends upwardly from the base. It connects the two side walls 4 and 5 across the front of the furniture piece. At least one drawer 10 extends from the front panel and further extends into the area between the two side walls. Also, at least one door covering 8 is positioned on the front panel and it covers a cavity 28 which is in the area between the two side walls.

Behind at least one door there could be provided a removable wine rack, which could be used for the storage of wine bottles. Also, behind other doors there could be provided adjustable interior shelving. In one drawer there could be provided a lined silver storage area. Also behind another door there could be provided a pencil tray or a file drawer. All of the different ramifications behind the drawers and doors would be to accommodate particular furniture accessories which are associated with either a server or a desk. The server/desk has a top section 12 which is composed of three parts. A first part is mounted above the two side walls and front panel and is fastened to these elements. The first part 14 has a front edge which overlies the front panel and a back edge which overlies the back of the furniture piece and both the front edges and back edges are parallel to each other. Hinged to the front edge and the back edge are two hinged sections 16 and 18 which normally rest upon the first part. One hinged section 16 is fastened to the front edge of the first part. The other hinged section 18 is attached to the back edge of the first part. The attachment to the first part is by appropriate hinges which permit the parts 16 and 18 to be hinged away from resting upon the top surface of first part 14. The two hinged sections 16 and 18 when they are resting upon the first part 14 together will be of the same length, which is measured from side wall to side wall, and the same width as measured from front edge to back edge. However, the sections 16 and 18 are really in two parts and the back section 18 is approximately one-third to one-fourth the width of the front section 16. The edges 22 and 24 of the two hinged sections are placed in an abutting relationship when the two sections are hinged down against the top surface of first part 14. A cavity 26 is provided in the back of the first part 14 and this cavity is completely covered by the hinged section 18 when that part is folded down so it rests upon the first part 14. The cavity is for the purpose of inserting dining room table fillers or leaves into the cavity for storage purposes. The front hinged section 18 is pivotal so that it will swing out in front of the front panel 16 as shown in the FIGURE. In the position shown in the FIGURE front hinge section 16 is in the same plane as the first part 14 and section 16 serves as a serving area or desk work top. Appropriate supports 30 slide out from the front panel 6 and support the hinged section 16 in its position shown in the drawing.

There is thus provided a furniture piece which may function as both a server and a desk. It also provides the additional feature of providing a storage area for the leaves which would be used with a companion table.

What is claimed is:

1. A furniture server/desk comprising a base with two side walls extending upwardly therefrom, a front panel having therein plural drawers and plural doors, said drawers extending into the area between the two side walls, said doors covering cavities within the two side walls, said server/desk having a top section consisting of a first part mounted above the two side walls and the front panel, said first part having a front edge on the top of the front panel and a back edge, a second part hinged thereto and overlying said first part, a third part hinged thereto and overlying said first part, said two hinged parts normally resting upon the first part with one hinged part being attached to the front edge of the first part and the other hinged part being attached to the back edge of the first part, said two hinged parts together in a side-by-side relationship resting on the first part and together forming a surface being the same size as the first part, said hinged part fastened to the back edge of the front part being approximately one-third to one-fourth the width of the hinged part fastened to the front edge of the first part, a cavity being positioned below and covered by the third hinged part, the second hinged part extending out over the front panel and being supported in position in the same plane as the first part to serve as a desk top.

2. A furniture server/desk as set forth in claim 1 wherein there is positioned a wine rack in at least one cavity covered by a door.

3. A furniture server/desk as set forth in claim 1 wherein the cavity positioned below and covered by the third hinged part has therein the leaves of a table which will be used in conjunction with the furniture server/desk.

* * * * *